US005356062A

United States Patent [19]

Kato

[11] Patent Number: 5,356,062

[45] Date of Patent: Oct. 18, 1994

[54] ROLL FEED APPARATUS FOR INTERMITTENTLY FEEDING A WORKPIECE

[75] Inventor: Heizaburo Kato, Shizuoka, Japan

[73] Assignee: Sankyo Manufacturing Co., Ltd., Tokyo, Japan

[21] Appl. No.: 134,861

[22] Filed: Oct. 12, 1993

Related U.S. Application Data

[63] Continuation of Ser. No. 799,285, Nov. 27, 1991, abandoned.

[30] Foreign Application Priority Data

Nov. 30, 1990 [JP] Japan ..... 2-334497

[51] Int. Cl.[5] ..... B65H 20/00; B41F 13/54

[52] U.S. Cl. ..... 226/31; 226/27; 226/36; 226/152

[58] Field of Search ..... 226/27, 31, 36, 152, 226/160

[56] References Cited

U.S. PATENT DOCUMENTS

| | | | |
|---|---|---|---|
| 1,607,528 | 11/1926 | Grover | 226/27 |
| 2,548,136 | 4/1951 | Auer | 226/27 |
| 3,186,273 | 6/1965 | Tomberg | 226/31 X |
| 3,204,842 | 9/1965 | Reimann | 226/31 X |
| 3,334,795 | 8/1967 | Cochrell | 226/31 |
| 3,539,085 | 11/1970 | Anderson et al. | 226/31 X |
| 3,586,224 | 6/1971 | Adams | 226/152 X |
| 3,608,799 | 9/1971 | Edson | 226/31 |
| 3,726,459 | 4/1973 | Defontenay | 226/152 |
| 3,768,715 | 10/1973 | Tout | 226/31 X |
| 4,007,866 | 2/1977 | Traise | 226/31 |
| 4,304,348 | 12/1981 | Kato | 226/152 |
| 4,919,049 | 4/1990 | Niedermaier et al. | 226/31 X |
| 5,062,561 | 11/1991 | Messner | 226/152 |
| 5,110,026 | 5/1992 | Messner | 226/152 |

FOREIGN PATENT DOCUMENTS

| | | |
|---|---|---|
| 48-101669 | 12/1973 | Japan . |
| 54-59675 | 5/1979 | Japan . |
| 55-92444 | 12/1980 | Japan . |

*Primary Examiner*—Daniel P. Stodola
*Assistant Examiner*—William Stryjewski
*Attorney, Agent, or Firm*—Pollock, Vande Sande & Priddy

[57] ABSTRACT

A roll feed apparatus of the type including a pair of rolls for clamping a workpiece therebetween and for intermittently feeding the workpiece, comprises a differential gear, operatively connected to at least one of the rolls, for rotating the roll(s). A mechanical feeding mechanism is connected to the deferential gear for outputting a rotational output thereof to the differential gear for effecting the intermittent feeding. Fine adjustment of the intermittent feeding is effected by an adjustment arrangement which includes a servomotor, also connected to the differential gear, for outputting a rotational output thereof to the differential gear, a rotational angle sensor for sensing a rotational angle of the servomotor to output a rotational angle signal representing the rotational angle sensed, reference position providing element for providing a reference position signal representing a reference position of the workpiece, and servomotor controller for comparing the rotational angle signal with the reference position signal to produce a signal representing the difference therebetween for controlling the servomotor to correct the difference.

6 Claims, 3 Drawing Sheets

ROLL FEED APPARATUS FOR INTERMITTENTLY FEEDING A WORKPIECE

This application is a continuation of U.S. Ser. No. 07/799,285 filed on Nov. 27, 1991, now abandoned.

BACKGROUND OF THE INVENTION

The present invention relates to a roll feed which may be used for feeding works to presses or the like.

The roll feed is a machine which holds a work between a pair of vertically aligned rolls, and feeds the work into dies of a press, for example, by intermittently rotating the rollers. Conventional roll intermittent rotation mechanisms, include a mechanical intermittent rotation mechanism, utilizing crank movement or other movement of the press, and an electrical intermittent rotation mechanism using a servomotor.

The mechanical intermittent rotation mechanism includes a one-way clutch type mechanism, a cam indexing type mechanism, etc. The one-way clutch type mechanism intermittently rotates rollers by a crank shaft through a drive rod and an oscillating lever whereas the cam indexing type mechanism intermittently drives the rollers by both a rotation cam, provided to the crank shaft, and an associated cam follower mounted on the roll side.

In the electrical intermittent rotation mechanism, there is a roll drive mechanism which intermittently rotates rollers by a servomotor. The rotation angle of the rollers is detected by an encoder or a pulse generator. By counting the number of pulses, the length of works fed is measured, and the results are fed back to the servomotor.

Recent presses require processing at a higher speed and a high accuracy. This requires high speed and high reliability for roll feeding. Other than high seed stability and high reliability, flexibility is required to meet and satisfy various other requirements, for example, in the case where works are to be fed at a high speed so as to synchronize to markings on works, and in the case where the roll feed is used for feeding works in secondary working in a high speed line.

In spite of these requirements, the conventional mechanical roll drive mechanism is difficult to control. More specifically, it is difficult to change the length of feed, feed speed and feed time although it is excellent in both high speed stability and reliability. On the other hand, the electrical roll drive mechanism is excellent in controllability but is inferior to the mechanical one in high speed feeding, stability, and reliability.

SUMMARY OF THE INVENTION

Accordingly, it is an object of the present invention to provide a roll feed which is excellent in controllability, high speed stability and reliability.

With this and other objects in view, the present invention provides a roll feed of the type including a pair of rolls to clamp a work therebetween for intermittently feeding the work, comprising: a differential gear, operatively connected to at least one of the rolls, for rotating the at least one roll; mechanical feeding means, connected to the differential gear, for outputting a rotational output thereof to the differential gear; a servomotor, connected to the differential gear, for outputting a rotational output thereof to the differential gear; rotational angle sensing means for sensing a rotational angle of the servomotor to output a rotational angle signal representing the rotational angle sensed; reference position providing means for providing a reference position signal representing a reference position of the work; and servomotor control means for comparing the rotational angle signal with the reference position signal to produce the difference therebetween and for correcting the difference to control the servomotor.

DETAILED DESCRIPTION OF THE PREFERRED EMBODIMENT

Figure 1:
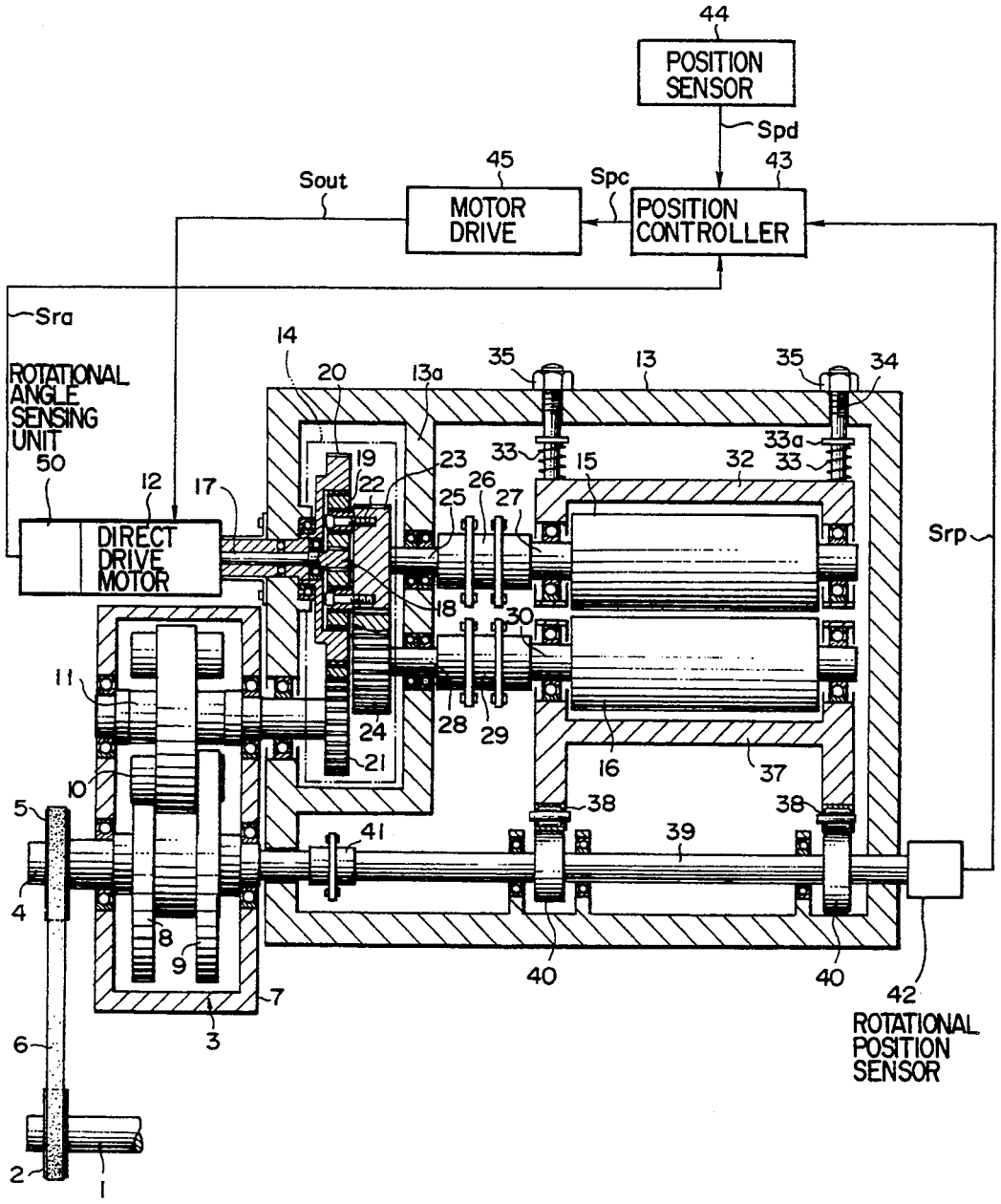
FIG. 1 is a front view in section of a roll feed according to the present invention.
Figure 2:
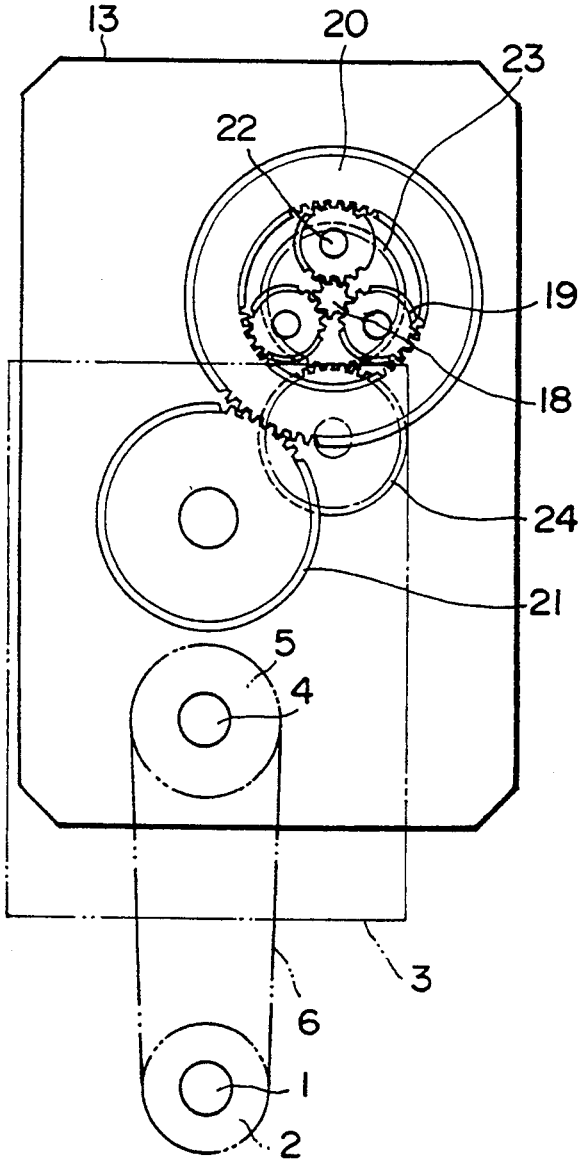
FIG. 2 is a diagrammatic left side view of essential portions of the roll feed of FIG. 1.

In FIGS. 1 and 2, the reference numeral 1 designates a crank shaft 1 of a press, the crank shaft 1 having a pulley 2 mounted around it. A belt 6 is extended between the pulley 2 and a pulley 5 mounted around an input shaft 4 of a cam indexing unit 3. The cam indexing unit 3 is of the parallel index type, and is provided within a casing 7 with parallel cams 8 and 9 and a cam follower 10. The parallel cams 8 and 9 are mounted on the input shaft 4 whereas the cam follower 10 an output shaft 11.

The cam indexing unit 3 and a direct drive motor 12 defining a servomotor are secured to a roll feed housing 13, within which a differential gear 14 and a pair of rolls 15 and 16, vertically aligned, are accommodated. The output shaft 17 of the direct drive motor 12 has a sun gear 18 of the differential gear 14 secured on it. Three planetary gears 19, 19 and 19 are meshed with the sun gear 18 at regular angular intervals, and are engaged with the internal gear of the ring gear 20. The outer gear of the ring gear 20 is meshed with a drive gear 21 mounted on the output shaft 11 of the cam indexing unit 3. The rotational shaft 22 of each of the three planetary gears 19, 19 and 19 is rotatably supported on one side of an upper roll gear 23 which is meshed with a lower roll gear 24 having the same diameter as the upper roll gear 23.

The rotary shaft 25 of the upper roll gear 23 rotatably supported on a partition wall **13*a* of the roll feed housing 13 is connected to the rotary shaft 27 of the upper roll 15 through a universal coupling 26 which is capable of absorbing displacement. Also, the rotary shaft 28 of the lower roll gear 24 which is rotatably supported on the partition wall 13*a* is coupled to the rotary shaft 30 of the lower roll 16**.

Figure 3:
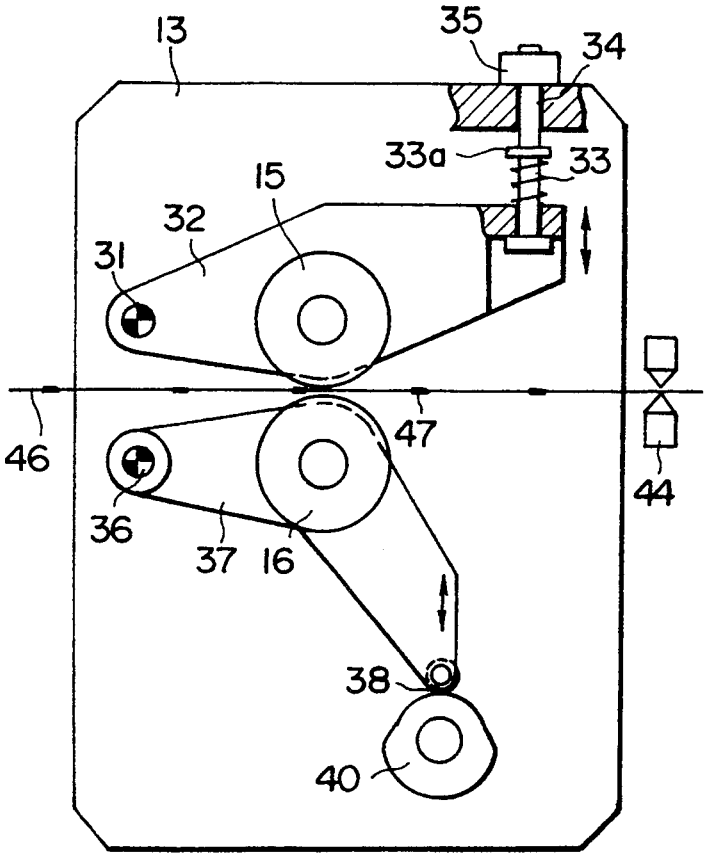
FIG. 3 is a diagrammatic right side view of essential portions of the roll feed of FIG. 1.

As shown in FIG. 3, the rotary shaft 27 of the upper roll 15 is rotatably supported on an upper roll casing 32, one end of which is pivotally supported on the roll feed housing 13 through a shaft 31. A pair of adjustment bolts 34 and 34 upwardly pass the one end of the upper roll casing 32 with heads thereof engaged with that one end. A compression coil spring 33 and an adjustment nut **33*a* are fitted around the shank of each of the adjustment bolts 34 and 34, and the shank projects upwardly from the roll feed housing 13 and an adjustment nut 35** is tightened to the projecting portion of the shank.

The rotary shaft 30 of the lower roll 16 is rotatably supported on a lower roll casing 37, one end of which is pivotally supported on the roll feed housing 13 through a shaft 36. A cam follower 38 is mounted on the other end of the lower roll casing 37, and is engaged with a release cam 40 mounted on a cam shaft 39. The cam shaft 39 is coupled at one end thereof to the input shaft 4 of the cam indexing unit 3 through a universal coupling 41. The other end of the cam shaft 39 passes through and projects from the roll feed housing 13, and has a rotational position sensing unit 42, such as a rotary encoder or a timing switch, mounted to it.

The rotational position sensing unit 42 outputs a rotational position detection signal Srp to a position controller 43 for determining feed timing of the direct drive motor 12. The rotational angle of the direct drive motor 12 is detected by a rotational angle sensing unit 50, such as a rotary encoder, and is inputted as a rotational angle signal Sra to the position controller 43. A position sensor 44 also outputs a positional detection signal Spd to the position controller 43. The position sensor 44 is, as shown in FIG. 3, arranged at a work traveling passage 60 outside the roll feed housing 13. The position controller 43 outputs a position control signal Spc to the motor driver 45, of which output Sout is in turn inputted to the direct drive motor 12. In FIG. 3, the reference signal 46 indicates a work sheet which extends through the gap between and is intermittently fed by the upper and lower rolls 15 and 16 along the work traveling passage 60. The work sheet has markings previously printed on it at regular intervals, the markings serving as working reference positions.

In operation, torque is transmitted from the crank shaft 1 of the press to the input shaft 4 of the cam indexing unit 3, and is converted by the parallel cams 8 and 9 and the cam follower 10 to intermittent rotational movement which is outputted from the output shaft 11. This intermittent rotational movement causes the ring gear 20 to rotate through the drive gear 21 mounted on the output shaft 11. On the other hand, the direct drive motor 12 is controlled by the motor driver 45 to rotate the sun gear 18. The three planetary gears 19, 19 and 19 are rotated by the rotation of the ring gear 20 in the same direction, so that the upper roll gear 23 is also rotated in the same direction through the 'rotational shafts 22 of the planetary gears 19, 19 and 19, with the result that the lower roll gear 24 which meshes with the upper roll gear 23 rotates in the reverse direction. This causes the upper and lower rolls 15 and 16 to rotate in the opposite directions through respective couplings 26 and 29, so that the work 46 clamped between the upper and lower rolls 15 and 16 is conveyed.

The clearance adjustment or clamping force adjustment of the upper and lower rolls 15 and 16 to correspond to the thickness of the work 46 is achieved by the adjustment nuts 35 and 33*a*. The misalignment of each roll 15, 16 to the corresponding rotary shaft 25, 28 due to this adjustment is absorbed by the universal coupling 26, 29. To temporarily release the work 46 for positioning it to the pilot pin or the like member of the die of the press, the release cams 40 which are connected to the input shaft 4 of the cam indexing unit 3 through the cam shaft 39 are turned to pivot the lower roll casing 16 downwardly about the shaft 36, and thereby the lower roll 16 is moved away from the upper roll 15.

The rotational angle sensing unit 50 detects the rotational angle of the direct drive motor 12 whereas markings 47 printed on the work 46 are sensed by the position sensor 44. The detected rotational angle and feed or the interval between adjacent markings 47 and 47 are compared by the position controller 43 to produce the difference, and the rotation of the direct drive motor 12 is controlled by the motor driver 45 so that the difference becomes smaller than a tolerance.

The rotational position sensing unit 42 is connected to the cam shaft 39 to synchronize in feed timing the mechanical feeder 3 with the direct drive motor 12.

The rotational output C of the output shafts 25 and 28 is given by the following equation:

$$C = K1 \cdot A + K2 \cdot B$$

where A represents a rotational output of the output shaft 17 of the direct drive motor 12; B a rotational output of the output shaft 11 of the cam indexing unit 3; K1 rotational ratio of the shaft 17 over the shaft 25; and K2 rotational ratio of the shaft 11 over the shaft 25. K2·B is constant since in the mechanical cam indexing unit 3 the rotational speed, the rotational angle, the timing, etc are constant. Thus, the rotational output C of the output shafts 25 and 28 may be changed according to a change in K1·A caused by controlling the rotation of the direct drive motor 12. The timing of feeding the work 46 by the upper and lower rolls 15 and 16 may be synchronized by the rotational position sensing unit 42 mounted on the cam shaft 39. According to information from the position sensor 44 the rotational angle of the direct drive motor 12 may be changed. These operations enable accurate intermittent feeding of the work 46 to synchronize with markings 47.

In the case where high speed feeding of a work 46 is made to synchronize with markings 47 which slightly change in pitch, the small difference in pitch may be absorbed by controlling the servomotor 12 by appropriately selecting the rotational output A of the servomotor and the rotational ratio K1 in the previously described equation $C = K1 \cdot A + K2 \cdot B$ whereas feeding according to the reference pitch may be achieved by the mechanical feeder 3. Thus, this embodiment utilizes advantages of both the mechanical and electrical feeders.

In the present invention, various types of differential gears may be adopted in place of the planetary gear.

In the previous embodiment, the differential gear 14 is provided with two output shafts 25 and 28. The differential gear 14 may however have only one output shaft which is connected to the lower roll 16. In this case, the upper roll 15 may follow the lower roll 16.

Instead of the direct drive motor 12, other conventional servo motors may be used. The cam indexing unit 3 may be replaced by other mechanical feed mechanisms.

In the previously described embodiment, markings 47 printed on the work 46 are used as reference positions for the servomotor control but other reference measures may be utilized.

What is claimed is:

1. A roll feed apparatus of the type including a pair of rolls for clamping a workpiece therebetween and for intermittently feeding the workpiece, said apparatus comprising:

a differential gear, operatively connected to at least one of the rolls, for rotating the at least one roll;

mechanical feeding means, including a cam indexing unit connected to said differential gear, for outputting a rotational output to said differential gear and for effecting a primary intermittent feeding of said workpiece; and means for controlling said intermittent feeding effected by said cam indexing unit and providing fine adjustment of rotation of the rolls, said controlling means including:

a) an electrical driving means, also connected to the differential gear, for outputting a rotational output to the differential gear;

b) rotational angle sensing means for sensing a rotational angle of the electrical driving means to output a rotational angle signal representing the rotational angle sensed;

c) reference position providing means for providing a reference position signal representing a reference position of the workpiece; and d) a control means for comparing the rotational angle signal with the reference position signal to produce a signal representing the difference therebetween and for controlling the electrical driving means to correct the difference;

whereby said mechanical feeding means allows stable and reliable primary intermittent feeding of the workpiece whereas said electrical driving means ensures fine adjustment of rotation of the rolls and correction of errors in feeding.

2. A roll feed as recited in claim 1, wherein the reference position providing means comprises a position sensor arranged at a travelling passage of the work piece to be fed by the rolls and wherein said cam indexing unit includes a casing, an input shaft and an output shaft mounted in said casing, a cam mounted for rotation about said input shaft and a cam follower mounted on said output shaft adapted to engage said cam.

3. A roll feed as recited in claim 1, further comprising rotational position sensing means for sensing a rotational position of the cam indexing unit to output a rotational position signal representing the rotation position, and wherein the control means compares the rotational angle signal with the rotational position signal and based on the comparison control the electrical driving means to synchronize it with the mechanical feeding means.

4. A roll feed apparatus of the type including a pair of rolls for clamping a workpiece therebetween and for intermittently feeding the workpiece, said apparatus comprising:

a differential gear, operatively connected to at least one of the rolls, for rotating the at least one roll;

a mechanical feeding means, including a mechanical intermittent rotation mechanism, connected to the differential gear, for outputting a rotational output to the differential gear and for primary feeding of said workpiece;

an electrical driving means including:

a) a servomotor, also connected to the differential gear, for outputting a rotational output to the differential gear;

b) rotational angle sensing means for sensing a rotational angle of the servomotor to output a rotational angle signal representing the rotational angle sensed;

c) reference position providing means for providing a reference position signal representing a reference position of the workpiece; and d) servomotor control means for comparing the rotational angle signal with the reference position signal to produce a signal representing the difference therebetween for controlling the servomotor to correct the difference;

whereby said mechanical feeding means allows stable and reliable primary intermittent feeding the workpiece whereas said electrical driving means ensures fine adjustment of rotation of the rolls and correction of errors in feeding.

5. A roll feed as recited in claim 4, wherein the reference position providing means comprises a position sensor arranged at a travelling passage of the workpiece to be fed by the rolls.

6. A roll feed as recited in claim 4, further comprising rotational position sensing means for sensing a rotational position signal representing the rotation position, and wherein the servomotor control means compares the rotational angle signal with the rotational position signal and based on this comparison controls the servomotor to synchronize it with the mechanical feeding means.

* * * * *